US006971215B2

(12) United States Patent
Wieduwilt et al.

(10) Patent No.: US 6,971,215 B2
(45) Date of Patent: Dec. 6, 2005

(54) DEVICE FOR INSERTING PACKING ITEMS INTO PACKING MATERIAL

(75) Inventors: Ulrich Wieduwilt, Schwaebisch Gmuend (DE); Guenther Lade, Berglen (DE); Eberhard Krieger, Weinstadt (DE); Ruediger Grabowski, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/332,819

(22) PCT Filed: May 10, 2002

(86) PCT No.: PCT/DE02/01693

§ 371 (c)(1),
(2), (4) Date: Aug. 27, 2003

(87) PCT Pub. No.: WO02/092432

PCT Pub. Date: Nov. 21, 2002

(65) Prior Publication Data

US 2004/0025472 A1 Feb. 12, 2004

(30) Foreign Application Priority Data

May 12, 2001 (DE) ..... 101 23 217

(51) Int. Cl.[7] ..... B65B 1/04; B65B 57/00

(52) U.S. Cl. ..... 53/250; 53/52

(58) Field of Search ..... 53/250, 52, 237, 53/251, 252

(56) References Cited

U.S. PATENT DOCUMENTS

| | | | | |
|---|---|---|---|---|
| 3,901,376 | A * | 8/1975 | Dardaine et al. | 53/247 |
| 5,657,610 | A * | 8/1997 | Dietrich et al. | 53/139.5 |
| 5,732,537 | A * | 3/1998 | Disrud | 53/566 |
| 5,787,680 | A | 8/1998 | Tisma et al. | |
| 5,791,124 | A * | 8/1998 | Spatafora | 53/456 |
| 5,794,417 | A | 8/1998 | Mohrman | |

FOREIGN PATENT DOCUMENTS

| | | |
|---|---|---|
| DE | 27 30 799 A1 | 1/1979 |
| DE | 198 48 452 A1 | 4/2000 |
| DE | 199 02 453 A1 | 7/2000 |
| EP | 0 465 437 A1 | 1/1992 |
| EP | 1 000 862 A2 | 5/2000 |

* cited by examiner

*Primary Examiner*—John Paradiso
(74) *Attorney, Agent, or Firm*—Ronald E. Greigg

(57) ABSTRACT

An apparatus for inserting packaged material into packaging means is described. In the region of an insertion device and a preinsertion device, a packaged-material conveyor device and a packaging-means conveyor device are provided. The insertion device has at least one insertion tappet, and the preinsertion device has a covering tongue corresponding to the insertion tappet. The insertion tappets and covering tongue can be guided essentially transversely to a direction of motion of the conveyor devices, which motions can each be generated by means of a respective servomotor drive mechanism, coupled to the insertion tappet and to the covering tongue. The insertion device and the preinsertion device are adjustable in oscillating fashion parallel to the direction of motion of the conveyor devices via a further servomotor drive mechanism coupled to them, and the drive mechanisms are triggerable separately via a drive control mechanism.

20 Claims, 5 Drawing Sheets

DEVICE FOR INSERTING PACKING ITEMS INTO PACKING MATERIAL

CROSS-REFERENCE TO RELATED APPLICATIONS

This application is a 35 USC 371 application of PCT/DE 02/01693 filed on May 10, 2002.

BACKGROUND OF THE INVENTION

1. Field of the Invention

The invention relates to an improved apparatus for inserting packaged material into packaging means, in particular for inserting blister strips preferably into folding boxes.

2. Description of the Prior Art

PRIOR ART

The invention relates to an apparatus for inserting packaged material into packaging means, in particular for inserting blister strips preferably into folding boxes, of the type defined in further detail in the preamble to claim 1.

An apparatus for inserting objects such as blister strips in particular into folding boxes is known from German Patent Disclosure DE 199 02 453 A1. This known apparatus is part of a cardboard-box-making machine and has a first conveyor device, revolving intermittently, for folding boxes disposed between slavers of the first conveyor device that are adjustable in terms of their spacing from one another. Parallel to and spaced apart from the conveyor device, there is a second conveyor device for the blister strips, which revolves intermittently in the same direction as the first conveyor device. The second conveyor device is provided with cups, open at the face end, in each of which a blister strip to be inserted is located during operation of the cardboard-box-making machine. An introduction helper is disposed in stationary fashion between the two conveyor devices and includes two plates, which are disposed vertically on a slipover plate and are pivotable in shafts. Also, between the introduction helper and the second conveyor device, there is a brochure delivery device, with brochure tongs, that keeps one brochure in readiness for each folding box.

On the side of the second conveyor device remote from the first conveyor device, the apparatus has a console, which is secured to a frame wall on the side opposite the conveyor devices that has an opening above the console.

On the console itself, three servomotors are secured; the first servomotor drives a toothed belt, which is deflected about three rollers supported on the console. Between the two rollers disposed on an upper level, a slaver that is displaceable in a horizontally oriented rod is secured to the toothed belt and is connected to an inserter acting as an insertion tappet. A length of the inserter, together with the adjustment path of the toothed belt between two of the three rollers, is adapted such that during the conveying phase of the conveyor devices, the front end of the inserter is located between the conveyor device for the blister strips and the frame wall. In the standstill phase of the conveyor devices, the front end of the inserter reaches as far as the opening cross section of the folding boxes, in order to insert the blister strips into the folding boxes.

A lever is secured to a drive shaft of a second servomotor and is coupled by means of a first rod to a retaining block that has a longitudinal bore. The second servomotor is also coupled with a striplike covering tongue, which upon insertion of the blister strips into a folding box is placed from above on the one blister strip or on a stack of blister strips and is guided together with the inserter in the direction of the folding boxes.

This known apparatus for inserting blister strips into folding boxes has the disadvantage, however, that it can be used only for intermittent operation of a cardboard-box-making machine, so that for a cardboard-box-making machine provided with the above-described apparatus, a maximum throughput is low compared to a continuous-operation cardboard-box-making machine.

From German Patent DE 43 06 170 C1, an apparatus for inserting blister strips into folding boxes is known with which a continuous operation of a cardboard-box-making machine is possible. This apparatus has a revolving packaged material insertion chain and a revolving container transport chain, which move parallel and synchronously next to one another over at least a portion of their revolution that is associated with the insertion operation. The packaged material insertion chain is disposed on the side of the packaged material transport chain facing away from the container transport chain and has carriages, on which the packaged material is guided transversely to the chain travel direction into insertion tappets that insert into the containers and are controllable relative to their insertion motion.

The apparatus of DE 43 06 170 C1 furthermore has means for positioning brochures in front of the insertion openings of the containers. To that end, the packaged material, upon insertion by holding-down tongues that act on it from above, are disposed on holding-down tappets oriented parallel to the insertion tappets and are guided longitudinally movably in sleds that are moved parallel to and synchronously with the carriages along the partial route. The revolving sleds are each guided with a respective cam roller on a self-contained cam path. The holding-down tappets, for the sake of their longitudinal displacement, are each guided with a respective control roller on a likewise self-contained control cam. The cam path and the control cam, over their total length, each follow the revolution of the carriages and are disposed on a cam holder that comprises at least two parts. Of these parts, at least one cam holder part is provided with the portions of the cam path and the control cam that are associated with the partial route, and this cam holder part, for the sake of format adaptation, is disposed so as to be adjustable relative to the carriages moving along the partial route, in the direction perpendicular to the longitudinal direction of the holding-down tappets and to the direction of motion of the carriages.

On each of the carriages, at least one guide column is provided, which is oriented essentially perpendicular to the direction of motion of the carriages and to the longitudinal direction of the holding-down tappets. Also, one of the carriages is guided displaceably, in a manner controlled by the cam path, on each of the guide columns.

A disadvantage here, however, is that this continuously operating apparatus is provided with revolving insertion tappets and insertion tongues, requiring a large number of moving parts for its operation, but of these only a small proportion are in engagement, which means a low degree of utilization of the required parts.

Another disadvantage is that the motion control is effected via fixed mechanical cam disks and shunts, which experience severe wear and have extremely limited flexibility in the case of changing requirements, because of different formats of the packaged material, made in terms of the insertion motion of the insertion tappets and insertion tongues.

SUMMARY OF THE INVENTION

The apparatus of the invention for inserting packaged material into packaging means, in particular for inserting blister strips into preferably folding boxes, has the advantage over the prior art that a cardboard-box-making machine provided with the apparatus of the invention can be operated continuously, and the various components of the apparatus experience only little wear. This is accomplished by providing that with the insertion principle of the invention, no revolution of one or more insertion tappets and one or more covering tongues or insertion tongues is required, since an insertion device and the preinsertion device can be adjusted by way of a translational back-and-forth motion parallel to the conveyor devices for the packaged material and for the packaging means, making a continuous packaging process possible.

Since the control of the motions of the insertion device and the preinsertion device is effected exclusively via servomotor drive mechanisms, no mechanical shunts or cam disks of the kind provided in the apparatuses known from the prior art are needed, so that complete independence of the insertion components for inserting packaged material into packaging means from other machine components is achieved.

A further advantage of the apparatus of the invention is that the number of moving parts is markedly less than in the continuously operatable apparatuses known from the prior art, and the dependence of the machine precision on the wear state of certain guide components of the insertion device and preinsertion device is substantially less, since complicated mechanical wearing parts, such as cam elements and shunts, are omitted. With the omission of the wear parts that are complicated to produce, production costs for an apparatus of the invention and the total price of a cardboard-box-making machine are reduced markedly.

Moreover, the apparatus of the invention has the advantage that each format change dictated by the packaged material or the packaging means can be embodied as software in a motor controller for the servomotors of the drive mechanisms. If changes in the packaged material and/or folding box and/or packaging means format are involved, then except for replacing format parts of the insertion device and the preinsertion device, no mechanical readjustments whatever are needed any longer, since essentially all the changes dictated by format or packaged material in the apparatus can be replicated by way of mathematical equations and stored in memory with software support in the drive controller. Moreover, the possibility advantageously exists of being able to react automatically to certain operating states, by means of suitable software stored in the servo controller.

Also in the apparatus of the invention, it is advantageous that a cardboard-box-making machine provided with the apparatus of the invention can be operated in either intermittent or continuous fashion; in intermittent operation of the cardboard-box-making machine, the motion of the compensatory weight and the preinsertion device parallel to the direction of motion of the conveyor devices by way of the further servomotor drive mechanism coupled with them is dispensed with.

The decoupling from other machine components and the use of the servomotor drive mechanisms make a flexible reaction to packaged material properties, in terms of dimensions, vulnerability, and location in a packaged-material cup of the conveyor device for furnishing packaged material, possible.

The motions of the insertion device and the preinsertion device can advantageously be adapted flexibly, that is, solely by changing individual program parameters, to the requirements of the packaged material, so that in this way the course of motion per se, which is described for instance by a travel, speed and acceleration profile, or individual values, such as an impact speed of the insertion tappet as it strikes the packaged material, or a maximum acceleration, can be varied, even during the operation of a cardboard-box-making machine, without making mechanical readjustments or replacing format parts.

A speed profile of the insertion tappet stroke can advantageously be used to facilitate the entire insertion operation effectively. Thus at a low speed of impact on the packaged material, a static friction between the packaged-material cup and the packaged material can be overcome without denting or buckling the packaged material. The packaged material is not subjected to the major component of the requisite acceleration until it is in the sliding friction region, when it is already in motion. As a consequence, the pressure force to be exerted on the packaged material by the preinsertion is reduced, so the possible damage to the packaged material is avoided in a simple way.

Also advantageously, the motor moment of the servomotor drive mechanisms can be monitored, and as a result, particularly in crash situations, an automatic overload detection is possible, by means of which, before damage to components of the apparatus of the invention occurs, an automatic machine stop can be performed.

BRIEF DESCRIPTION OF THE DRAWINGS

One exemplary embodiment of the invention will be explained in further detail in the ensuing description with refernce to the drawings, in which.

DESCRIPTION OF THE PREFERRED EMBODIMENT

Figure 1:
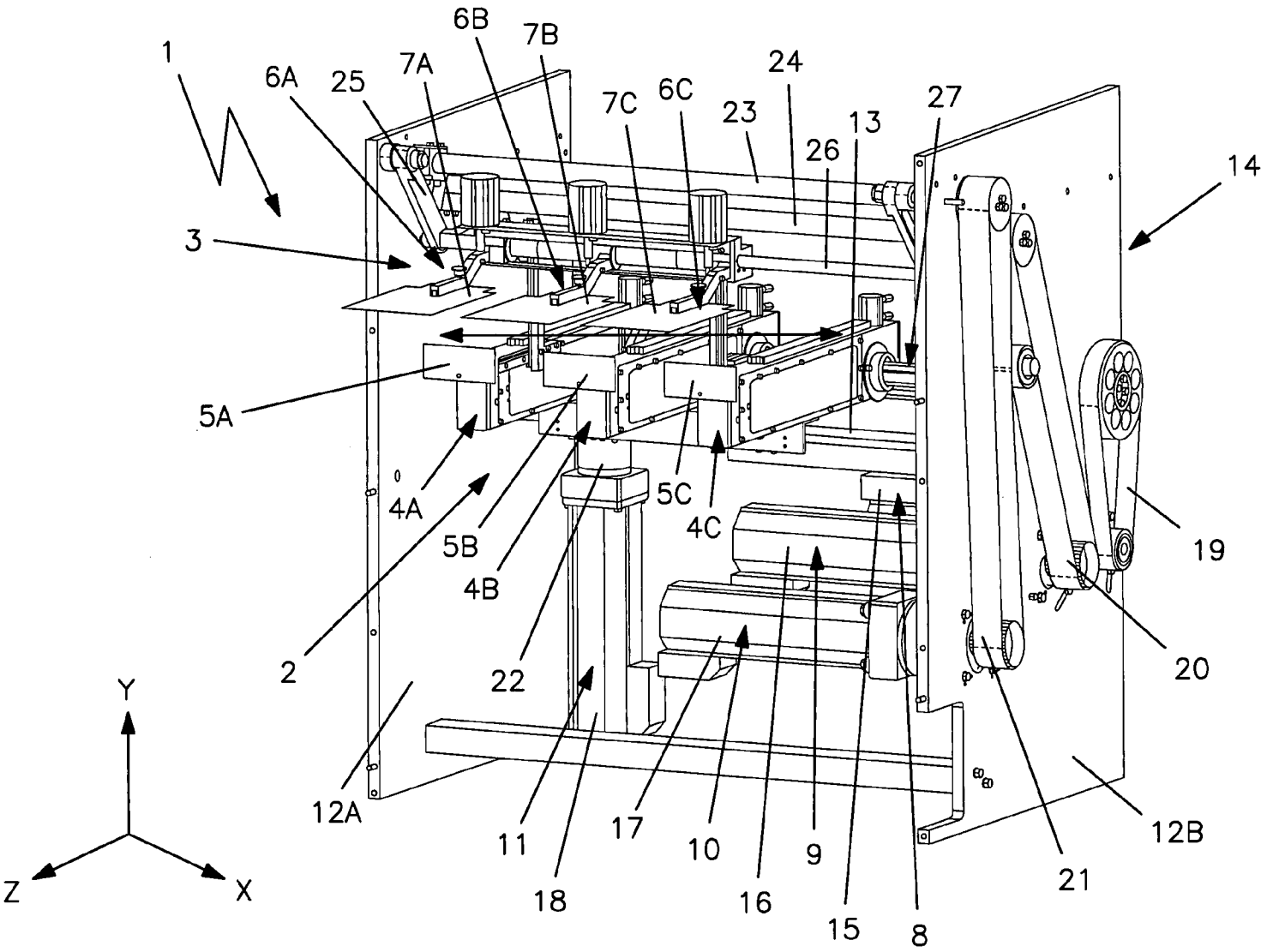
FIG. 1, a schematic three-dimensional view of an apparatus for inserting blister strips in folding boxes.

The apparatus 1 shown in the drawings is part of a cardboard-box-making machine and is used for instance to insert blister strips into folding boxes. The apparatus 1 has an insertion device 2 and a preinsertion device 3, which correspond with a first conveyor device, not shown in detail, for furnishing blister strips or packaged material and with a second conveyor device for furnishing folding boxes or packaging means.

The insertion device 2 comprises a plurality of insertion modules 4A, 4B, 4C, which each have one insertion tappet 5 for displacing the packaged material. The preinsertion device 3 is formed of a plurality of preinsertion modules 6A, 6B, 6C, which each have one covering tongue 7A, 7B, 7C corresponding to a respective insertion tappet 5A, 5B, 5C of the insertion modules 4A, 4B, 4C.

The insertion tappets 5A–5C and the covering tongues 7A–7C can be guided transversely to a direction of motion of the conveyor devices; the motions of the insertion tappets 5A–5C and covering tongues 7A–7C can each be generated by means of a respective servomotor drive mechanism 8, 9, 10 coupled with the insertion tappets 5A–5C and the covering tongues 7A–7C.

The insertion device 2 and the preinsertion device 3 are adjustable in oscillating fashion, in the continuous-operation mode of the apparatus 1, via a further servomotor drive mechanism 11 coupled with them. This motion of the insertion device 2 and the preinsertion device 3 is represented by the double arrow in FIG. 1 and is accomplished via a transverse stroke drive mechanism of the apparatus 1; in the present exemplary embodiment term "transverse" means crosswise to the insertion direction.

The apparatus 1 has a holder frame 14, which comprises two lateral frame plates 12A, 12B and one base plate 13 and which receives the insertion device 2 and the preinsertion device 3. The base plate 13 takes on the task of stabilizing the holder frame 14 and moreover of supporting the insertion modules 4A–4C.

The apparatus 1, that is, the insertion device 2 and the preinsertion device 3, have four individual motions, which are generated via four servomotors 15, 16, 17, 18, with suitable intermediate gears 19, 20, 21, 22.

For better explaining the various directions of motion, in FIG. 1 a Cartesian coordinate system is shown, with an X, Y and Z direction. The oscillating motion of the insertion device 2 and preinsertion device 3 is accordingly provided in the X direction via the servomotor drive mechanism 11 or transverse stroke drive mechanism, and the motion of the insertion tappets 5A–5C in the Z direction is performed via the servomotor drive mechanism 8 or tappet stroke drive mechanism. A motion of the preinsertion device 3 or covering tongues 7A–7C is generated by means of the servomotor drive units 9, 10, or their intermediate gears embodied as toothed belt gear stages 20, 21. Via the servomotor drive mechanism 9, a motion of the covering tongues 7A–7C primarily in the Y direction is generated, and via the servomotor drive mechanism 10, a motion of the covering tongues 7A–7C primarily in the Z direction, that is, an approximately horizontal motion, is effected.

The motions of the toothed belt gear stages 20, 21 are introduced via two drive shafts 23, 24 into two identical lever mechanisms 25, each disposed directly beside the frame plates 12A, 12B, and are superimposed by means of a guide shaft to make a combined motion; the preinsertion device 3 is disposed displaceably in the X direction or transverse stroke direction on the guide shaft 26. The transverse stroke direction of the preinsertion device 3 is derived directly from a transverse stroke motion of the insertion device 2.

The task of covering the packaged material to be inserted, or blister packs, is taken on by the covering tongues 7A–7C, which each represent the functional component of a preinsertion module 6A, 6B, and 6C, respectively.

The driving motion is transmitted by the servomotor 15 of the servomotor drive mechanism 8, via the intermediate gear 19 embodied as a toothed belt gear stage, to a profile shaft 27 supported in the holder frame 14.

Figure 2:
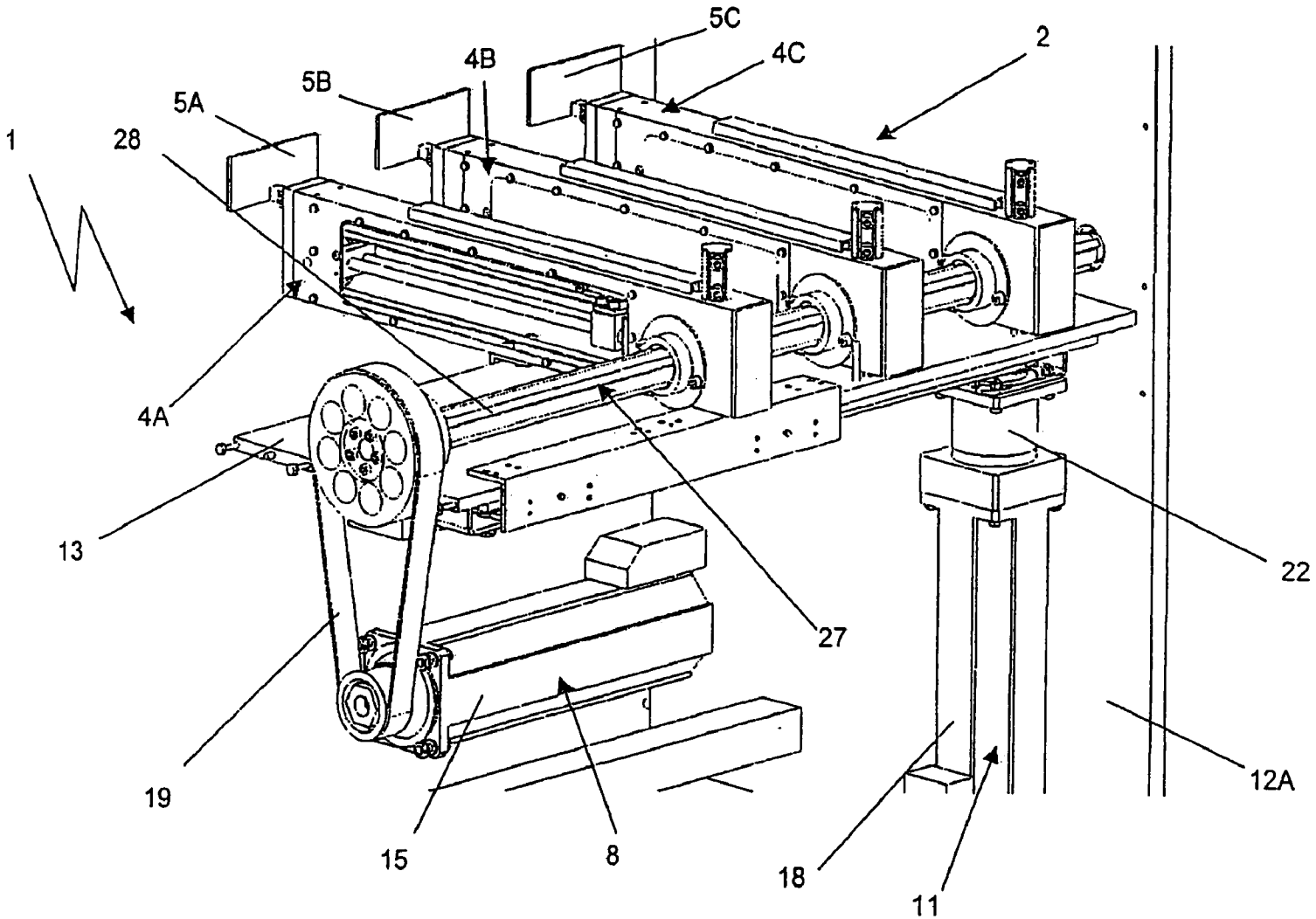
FIG. 2, an insertion device of the apparatus of FIG. 1, in a partly simplified perspective view.
Figure 3:
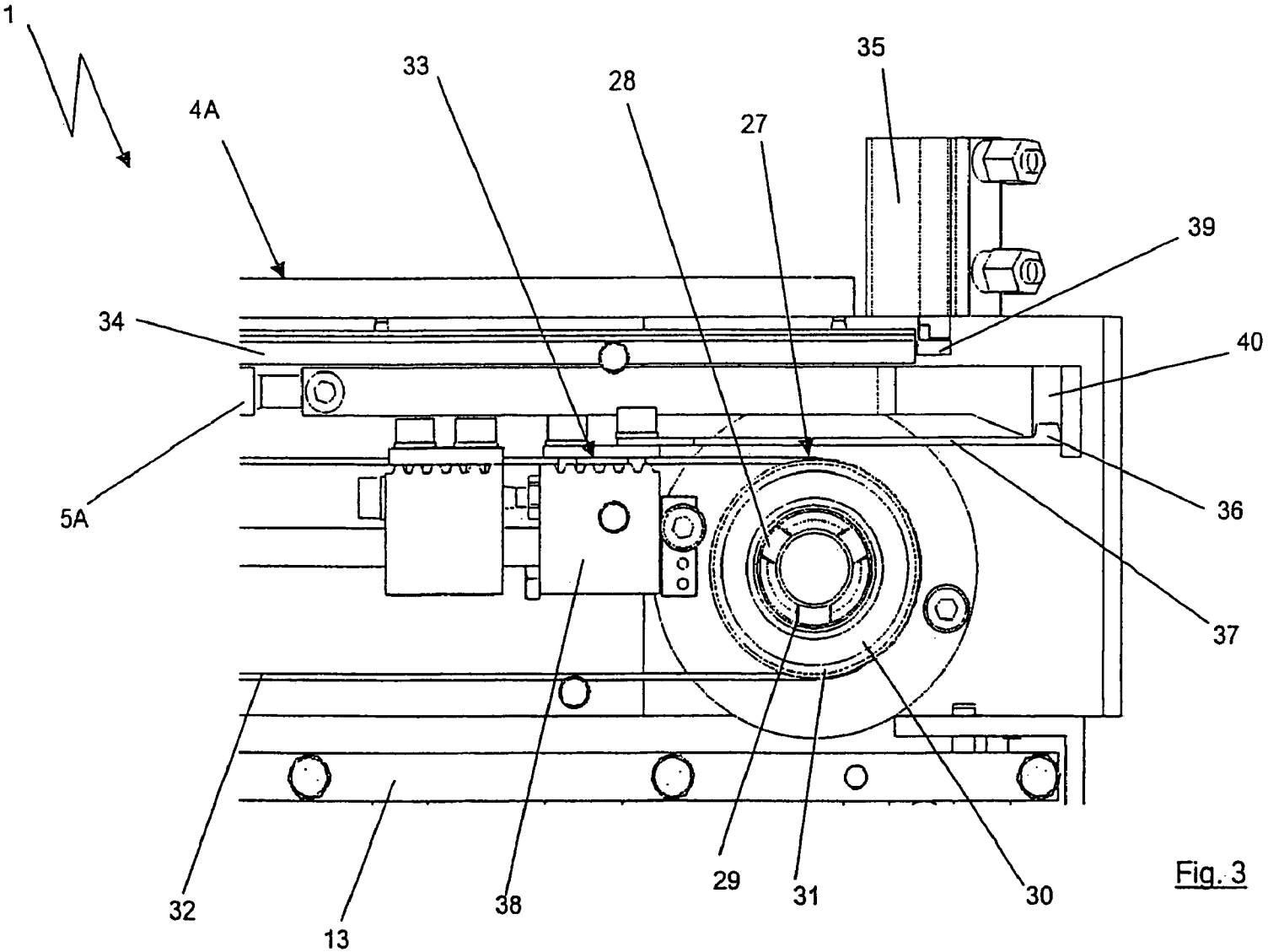
FIG. 3, a detail of a releasing device for disconnecting an insertion tappet from a toothed belt.

An enlarged, schematic view of the insertion device 2 is shown in FIG. 2; the profile shaft 27 has a plurality of lugs or protrusions 28, which are distributed over the circumference and extend in the axial direction of the profile shaft 27, and which engage grooves 29, shown in more detail in FIG. 3, in a slide piece 30, disposed on the profile shaft 27, in order to form a positive-engagement connection between the profile shaft 27 and the slide piece 30.

Because of the structural design of the insertion device 2, with the profile shaft 27 and with the slide piece 30 solidly joined to it in the direction of rotation, which slide part is disposed slidingly on the profile shaft 27 in its axial direction, the displaceability of the insertion modules 4A–4C in the transverse stroke direction or X direction of the apparatus 1 is achieved with simultaneous introduction of a torque into the slide piece 30.

In FIG. 3, an enlarged view of the connection between the profile shaft 27 and the slide piece 30 is shown; the slide piece 30 has a toothed profile 31 on its outer circumference and thus drives a toothed belt 32. Via a driver device 33, the insertion tappet 5A is separably connected to the toothed belt 32 and is driven by it. To that end, the toothed belt 32 is reinforced via a guide rail 34. The releasing and restoration of the connection between the toothed belt 32 and the insertion tappet SA is achieved with the aid of a pneumatic cylinder 35.

The unsnapping of the insertion tappet 5A from the connection with the toothed belt 32 represents a safety function of the insertion device 2, which can be activated in the event of the wrong or a missing packaged material or the wrong, or a defective or missing folding box. To that end, the insertion tappet 5A is guided via the guide rail 34, while the drive of the insertion tappet 5A is effected by the toothed belt 32, via a spring baffle 37 provided with a lug 36. The spring baffle 37 is solidly connected to the toothed belt 32 via a driver 38 of the driver device 33; the connection between the drive 38 and the toothed belt 32 is embodied, in the present exemplary embodiment, by a clamping action, which is produced by way of a screw device 39 between the driver 38 and the toothed belt 32. It is understood that it is up to one skilled in the art whether to provide some other connection option, such as a positive-engagement connection.

If the insertion tappet is in its position of repose, which is shown approximately in FIG. 3, and if a signal to release the insertion tappet 5A from the toothed belt 32 is present at the pneumatic cylinder 35, then a pin or the piston rod 39 of the pneumatic cylinder 35 passes through a through bore 40, made in the insertion tappet 5A, in which the lug 36 of the spring baffle 37 is disposed, and guides the lug 36 of the spring baffle 37 out of the bore 40 of the insertion tappet 5A. As a result, the insertion tappet 5A and the toothed belt 32 are disconnected from one another, with the result that the toothed belt 32, in the case of drive by means of the servomotor drive unit 8, executes a motion in the Z direction, that is, in the direction of the two conveyor devices, without an insertion tappet. The insertion tappet 5A is kept in its position of repose by the pneumatic cylinder 35, or its piston rod 39.

Upon the reverse motion of the toothed belt 32, the spring baffle 37 connected to it is also moved back into its rearmost position, and upon release of the insertion tappet 5A, or its bore 40, by the pneumatic cylinder 35 or its piston rod 39, it can snap back into the bore 40 again for the next work cycle of the insertion tappet 5A.

Figure 4:
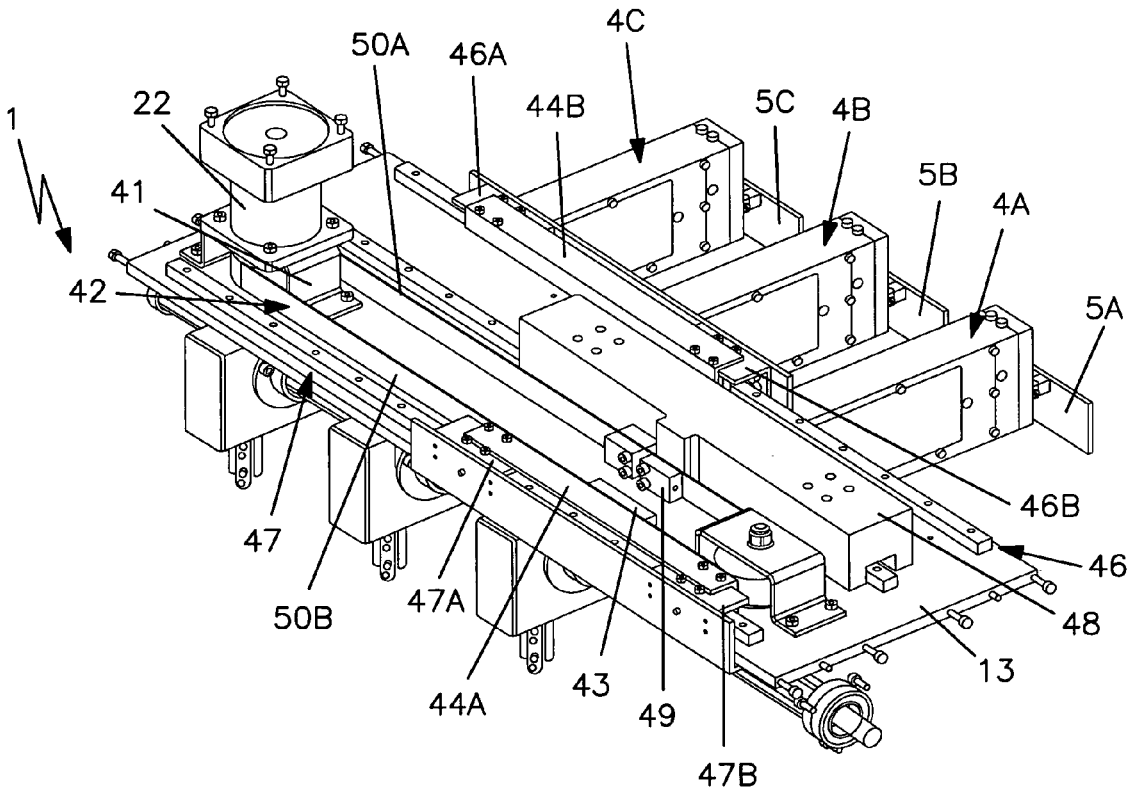
FIG. 4, a perspective view of a bearing of the insertion device in the transverse stroke direction.

The transverse stroke drive mechanism of the insertion device 2 and preinsertion device 3 is realized by the servomotor 18 and the intermediate gear or planetary gear 22 preceding it; the motion of the servomotor 18 is transmitted to a further toothed belt 42 via a toothed belt pulley 41, shown in further detail in FIG. 4. A driver element 43 is secured to the further toothed belt 42 and is furthermore solidly connected to one of two transverse holders 44A and 44B. The displaceable bearing of an insertion table, or of the transverse holders 44A, 44*b* of the insertion device 2—and hence of the insertion modules 4A–4C themselves—is effected via suitable guide elements, which in the present exemplary embodiment are embodied as linear guide systems 46, 47, each with two carriages 46A, 46B, 47A, 47B.

To compensate for motion-dictated forces and to prevent possible oscillation of the holder frame 14, a compensatory weight 48 is provided, which runs counter to the direction of motion of the transverse holders 44A, 44B. To this end, the compensatory weight 48, with the aid of a further driver 49, is secured to one run 50A of the further toothed belt 42, which is located opposite a run 50B, connected to the transverse holder 44A, of the further toothed belt 42.

Figure 5:
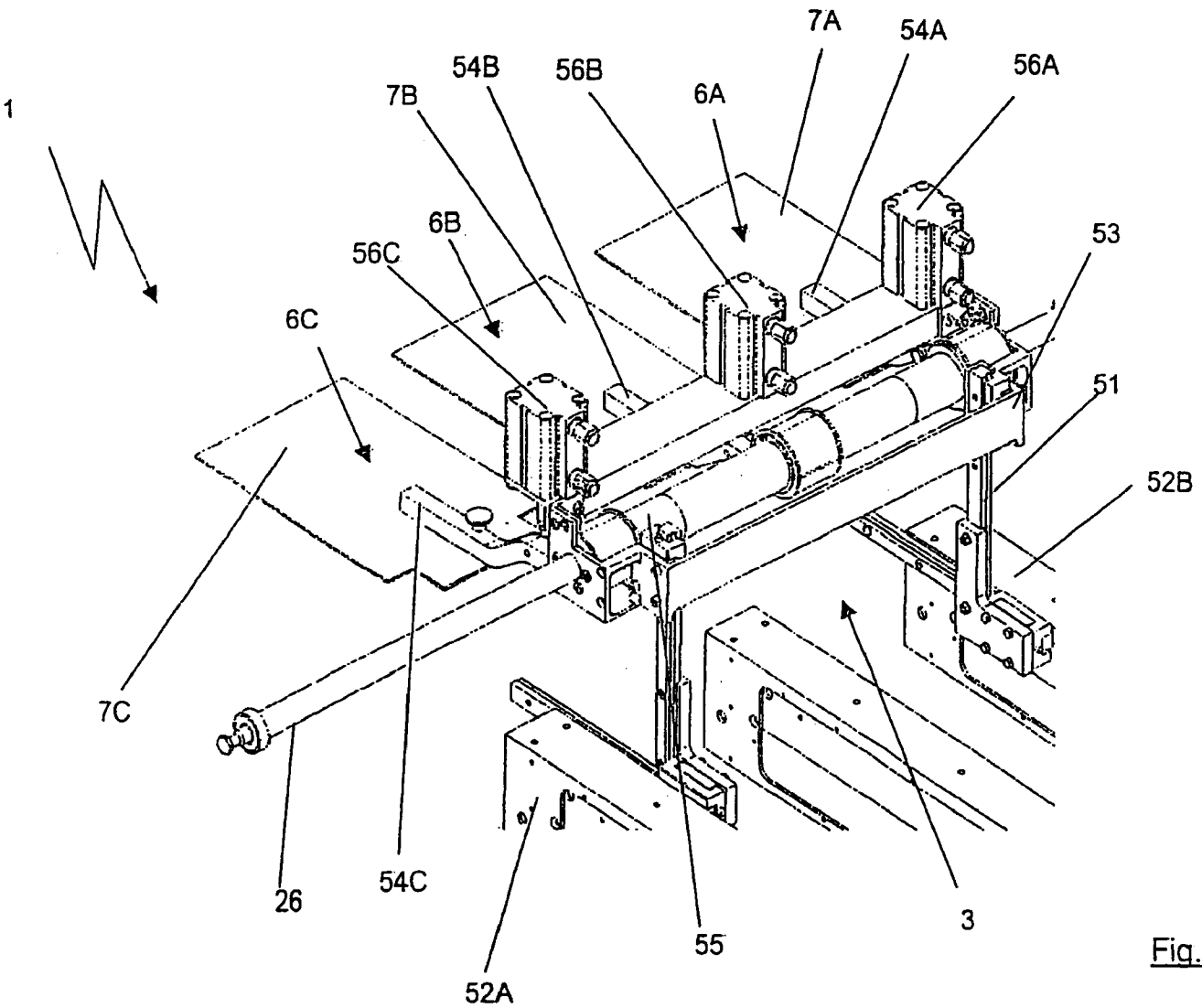
FIG. 5, a preinsertion device, in a perspective rear view, in a partly simplified illustration.

The motion of the preinsertion device 3 in the transverse stroke direction is derived directly from the insertion device 2, via a suitable guide system, such as the crosshead guide 51, shown in FIG. 5, tied to holder profiles 52A, 52B of the insertion device 2, and is linked, by the displaceable disposition of the preinsertion device 3 on the guide shaft 26, with the horizontal and lowering motions of the preinsertion device 3 in the Z direction and Y direction that are realized via the separate servomotor drive mechanisms 9, 10 that are shown in FIG. 1. The holder profiles 52A, 52B each serve as a receptacle for the toothed belt 32, the insertion tappet 5A, and the driver device 33.

The central component of the preinsertion device 3 is the transverse guide 53, which along with guide elements for the transverse stroke motion of the preinsertion device 3 also receives the tongue guides 54A–54C and thus the cover plates or covering tongues 7A–7C. The tongue guides 54A–54C are rotatably supported on the sleds 55 that are solidly connected to the transverse guide 53.

With the aid of further pneumatic cylinders 56A–56C, the covering tongues 7A–7C can be raised in the event of the wrong or missing packaged material or the wrong, defective, or missing folding boxes, and thus folded out of the way around the sled 55 upward or in the Y direction, in such a way that in conjunction with the unsnapping or release of the corresponding insertion tappet 5A–5C, the possibility is achieved of allowing defective cycles to pass unhandled through a cardboard-box-making machine. All the insertion tappets 5A–5C and the covering tongues 7A–7C and pneumatic cylinders 35A–35C corresponding with them as well as the further pneumatic cylinders 56A–56C are triggerable individually, via a control unit, not shown in detail, of the apparatus 1. The same is true for the servomotor drive mechanisms 8, 9, 10, 11, which are likewise triggerable separately from one another via a drive control unit not shown in further detail.

As input variables, among others the speed of motion of the two conveyor devices, which determines the capacity of a cardboard-box-making machine, and the height and length of a blister stack can be specified to this drive control unit, for instance via an input keyboard. On the basis of the input variables, the drive control unit calculates the requisite motions of the insertion device 2 and preinsertion device 3, as well as of the servomotor drive mechanisms 8–11 coupled with them. It is understood that the motions which are generated by the servomotor drive mechanisms 8–11 can also be stored in memory beforehand in the drive control unit in the form of predetermined function courses, which are each called up in accordance with predetermined input variables pertaining to the packaged material and the packaging means. These functional courses are preferably determined empirically in advance.

The mode of operation of the apparatus 1 will now be explained in further detail.

One stack of blister strips and one folding box are each delivered to the apparatus 1 by the two conveyor devices, which can be driven either continuously or intermittently. If one stack of blister strips and one folding box is located in coincidence in front of one of the insertion tappets 5A–5C and the covering tongues 7A–7C corresponding with them, then the applicable insertion tappet 5A–5C is moved out of its retracted terminal position, or position of repose, transversely to the direction of motion of the conveyor devices. The covering tongue 7A–7C corresponding with it is simultaneously moved in the Z direction and in the negative Y direction, so that the covering tongue 7A–7C comes to contact one stack of blister strips and firmly holds it from above. The insertion tappet 5A–5C, which in the present exemplary embodiment has a platelike end, is inserted together with the covering tongue 7A–7C and the stack of blister strips into the folding box. In the process, the packaged material, or stack of blister strips, is secured at the top by the covering tongue 7A–7C to prevent its being dented or buckled, and optionally, a brochure moved parallel to the folding box is inserted together with the packaged material into the folding box in a defined way.

On the basis of the combined motion of the preinsertion device 3 and covering tongues 7A–7C in the Z direction and the Y direction, it is possible, after the covering tongues 7A–7C have moved into a folding box, for a top side of the folding box to be raised by the covering tongues 7A–7C in order to widened the insertion opening of the folding box, which makes it easier to insert the packaged material or a stack of blister strips through the body of the folding box. The strokes of the covering tongues 7A–7C to be executed in the process can be adjusted flexibly within logical limits.

Because of the transverse stroke drive mechanism of the insertion device 2 and preinsertion device 3, the possibility exists of having the insertion device 2 and the preinsertion device 3, or the insertion tappets 5A–5C and the covering tongues 7A–7C, follow along with the conveyor devices for furnishing the packaged material and the packaging means, or move parallel to them at the same conveying speed. After the packaged material has been inserted into the applicable packaging means, the insertion device 2 and the preinsertion device 3 are moved back in a direction opposite the conveying direction of the two conveyor devices, so that a new insertion operation can be performed. As a result, a cardboard-box-making machine which has the present apparatus 1 in the form of a component group, can be operated continuously.

It is understood that it is within the judgment of one skilled in the art to provide a plurality of insertion modules and a plurality of preinsertion modules in order to increase the throughput of a cardboard-box-making machine. Moreover, to make it possible to operate a cardboard-box-making machine intermittently, it is also within the judgment of one skilled in the art to deactivate the described transverse stroke drive mechanism of the insertion device 2 and preinsertion device 3.

With the apparatus 1 presented, it is possible to react flexibly to the wrong products in a packaged-material cup of the conveyor device for furnishing packaged material and to the wrong, defective, or missing folding boxes and brochures. If the packaged material or the folding box in one section of the packaged material or folding box chain is detected as being defective, then the insertion in the preceding sections proceeds more slowly or optionally faster, so that the defective section is the first section of a packaged material group to be handled to reach the insertion region. A packaged material group represents a number of sections equal to the number of insertion tappets. Then for the duration of the passage through the system of the defective section or sections, the insertion operation is absent, or the reverse-travel component of the transverse stroke of the insertion device 2 and the preinsertion device 3 is slowed down appropriately, so that the defective section passes through the insertion region unhandled, and the components can be rejected at the end of the cardboard-box-making machine.

The foregoing relates to preferred exemplary embodiments of the invention, it being understood that other variants and embodiments thereof are possible within the spirit and scope of the invention, the latter being defined by the appended claims.

We claim:

1. An apparatus (1) for inserting packaged material into packaging means, in particular for inserting blister strips preferably into folding boxes, comprising, an insertion device (2) and a preinsertion device (3), a first conveyor device for furnishing packaged material and a second conveyor device for furnishing packaging means to the region of the insertion device (2) and the preinsertion device (3), the insertion device (2) having at least one insertion tappet (5A–5C) for displacing the packaged material and the preinsertion device (3) having a covering tongue (7A–7C), corresponding with the insertion tappet (5A–5C), the insertion tappet (5A–5C) and the covering tongue (7A–7C) being guidable essentially transversely to a direction of motion of the conveyor devices, the motions of the insertion tappet (5A–5C) and of the covering tongue (7A–7C) can be generated each by means of a respective servomotor drive mechanism (8, 9) coupled with the insertion tappet (5A–5C) and the covering tongue (7A–7C), a further servomotor drive mechanism (11) coupled to the insertion device (2) and the preinsertion device (3) and operable to impart adjustable oscillating movement of the insertion device (2) and preinsertion device (3) parallel to the direction of motion of the conveyor devices, and the drive mechanisms (8, 9, 11) are triggerable separately via a drive control mechanism.

2. The apparatus of claim 1, further comprising a holder frame (14) for receiving the insertion device (2) and the preinsertion device (3) which holder frame (14) has two lateral frame plates (12A, 12B) and a base plate (13), the base plate (13) acting as a stabilizer of the holder frame (14) and as a support for the insertion device (2).

3. The apparatus of claim 1, wherein the drive mechanisms (8, 9, 11) each comprise at least one servomotor (15, 16, 18), and for adjusting the preinsertion device (3) vertically to the direction of motion of the conveyor devices, the preinsertion device (3) is coupled to an additional servomotor drive mechanism (10).

4. The apparatus of claim 3, wherein the drive mechanisms (8, 9, 10, 11) of the insertion device (2) of the preinsertion device (3) each comprise at least one intermediate gear (19, 20, 21, 22).

5. The apparatus of claim 4, wherein the drive mechanism (8) for creating the motion of the insertion tappet (5A–5C) transversely to the direction of motion of the conveyor devices comprises an intermediate gear, embodied as a toothed belt gear stage (19), by way of which a drive of the servomotor (15) can be transmitted to a profile shaft (27) supported in the frame plates (12A, 12B).

6. The apparatus of claim 5, wherein the profile shaft (27) comprises a plurality of protrusions (28), distributed over its circumference and extending in the axial direction of the profile shaft (27), which protrusions engage grooves (29) in a slide piece (30), disposed on the profile shaft (27), for forming a positive-engagement connection.

7. The apparatus of claim 6, wherein the slide piece (30) is disposed axially displaceably on the profile shaft (27).

8. The apparatus of claim 6, wherein the slide piece (30) on its outside has a toothed profile (31) which is engaged by a toothed belt (32).

9. The apparatus of claim 8, wherein the toothed belt (32) comprises a driver device (33), by way of which the insertion tappet (5A–5C) is separably connected to the toothed belt (32).

10. The apparatus of claim 8, wherein the driver device (33) comprises a spring baffle (37), provided with a lug (36) which engages a bore (40) of the insertion tappet (5A–5C).

11. The apparatus of claim 10, further comprising a releasing device for guiding the lug (36) out of the bore (40) of the insertion tappet (5A–5C).

12. The apparatus of claim 11, wherein the releasing device comprises a pneumatic cylinder (35A–35C), which is disposed such that to release the connection between the toothed belt (32) and the insertion tappet (5A–5C), a piston rod (39) of the pneumatic cylinder (35A–35C) can be introduced into the bore (40) of the insertion tappet (5A–5C), so that the lug (36) is pressed out of the bore (40) and the insertion tappet (5A–5C) is locked in its position of repose by the piston rod (39).

13. The apparatus of claim 9, wherein the insertion device (2) comprises a holder profile (52A, 52B), in which at least the toothed belt (32), insertion tappet (5A–50), and driver devices (33) are disposed.

14. The apparatus of claim 4, wherein the intermediate gear of the drive mechanism (11) for moving the insertion device (2) and the preinsertion device (3) parallel to the direction of motion of the conveyor devices is embodied as a planetary gear (22).

15. The apparatus of claim 14, wherein the rotational drive of the planetary gear (22) can be transmitted as a translational motion to one of the transverse holders (44A–44B) via a toothed belt pulley (41), a further toothed belt (42), and a driver element (43) connected to the further toothed belt (42).

16. The apparatus of claim 14, wherein to compensate for motion-dictated forces and to reduce vibration of the holder frame (14), a compensatory weight (48) is provided, which runs counter to the respective direction of motion parallel to the motion of the conveyor devices of the insertion device (2) and is preferably secured to one run (50A) of the further toothed belt (42) that is opposite a run (50B), connected to one of the transverse holders (44A or 44B), of the further toothed belt (42).

17. The apparatus of claim 3, wherein the motions of the preinsertion device (3) can be generated via two drive shafts (23, 24), coupled to servomotors (16, 17), and lever mechanisms (25) connected to the drive shafts (23, 24), and the two motions can be superimposed by means of a guide shaft (26) to create a combined motion.

18. The apparatus of claim 17, wherein the covering tongue (7A–7C) is rotatably supported on the guide shaft (26) and is pivotable about the guide shaft (26) by means of a further pneumatic cylinder (56A–56C).

19. The apparatus of claim 1, wherein the insertion device (2) is supported on transverse holders (44A, 44B), which are connected to the base plate (13) via linear rail guide systems (46, 47) and carriages (46A, 46B, 47A, 47B) corresponding with them.

20. The apparatus of claim 1, wherein the motion of the preinsertion device (3) parallel to the direction of motion of the conveyor devices can be imposed on the preinsertion device (3) via a crosshead guide (51) connected to the insertion device (2).

* * * * *